US005826775A

United States Patent [19]

Mooney et al.

[11] Patent Number: 5,826,775

[45] Date of Patent: Oct. 27, 1998

[54] SOCK CLIP SYSTEM

[76] Inventors: Linda Mooney, 214 Briar Rd., Rogersville, Mo. 65742; Lynette Jennings, 103 Secluded La., Nixa, Mo. 65714

[21] Appl. No.: 853,360

[22] Filed: May 8, 1997

[51] Int. Cl.[6] ..... B65C 7/00

[52] U.S. Cl. ..... 227/67; 227/76; 227/156; 112/285; 7/160

[58] Field of Search ..... 227/67, 68, 71, 227/21, 63, 76, 156, 31; 112/222, 226, 285; 7/160

[56] References Cited

U.S. PATENT DOCUMENTS

| | | | |
|---|---|---|---|
| 3,948,128 | 4/1976 | Russell | 227/76 |
| 4,025,031 | 5/1977 | Chi | 227/156 |
| 4,187,970 | 2/1980 | Furutu | 227/67 |
| 4,492,330 | 1/1985 | Furutsu | 227/156 |
| 4,534,464 | 8/1985 | Lankton | 227/76 |
| 5,183,196 | 2/1993 | Miyashita | 227/63 |
| 5,320,269 | 6/1994 | Deschenes et al. | 227/76 |
| 5,720,062 | 2/1998 | Vaught | 7/160 |
| 5,722,335 | 3/1998 | Kamewada et al. | 112/285 |

*Primary Examiner*—Scott A. Smith

[57] ABSTRACT

A new Sock Clip System for securing stocking, socks, and hose and the like, into their proper pairs for ease of sorting for laundry and storage. The inventive device includes a clip inserting mechanism having a handle for inserting a resilient clip into clothing, a slot projected into the handle, and a blade secured within the slot within the handle for cutting the resilient clip preparing the secured clothing for utilization. In an alternative embodiment, the blade may be removably secured to the handle by a U-shaped member having a flange with slidably projects into a T-slot within the handle.

6 Claims, 3 Drawing Sheets

10
20
22
26
28
30
34
32
24

20
22
26
28
24

SOCK CLIP SYSTEM

BACKGROUND OF THE INVENTION

1. Field of the Invention

The present invention relates to Clothing Securing Devices and more particularly pertains to a new Sock Clip System for securing stocking, socks, and hose and the like, into their proper pairs for ease of sorting for laundry and storage.

2. Description of the Prior Art

The use of Clothing Securing Devices is known in the prior art. More specifically, Clothing Securing Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Clothing Securing Devices include U.S. Pat. No. 5,398,859; U.S. Pat. No. 5,373,656; U.S. Design Patent 286,166; U.S. Pat. No. 5,405,070; U.S. Pat. No. 5,321,872 and U.S. Pat. No. 5,440,791.

While these devices fulfill their respective, particular objectives and requirements, the aforementioned patents do not disclose a new Sock Clip System. The inventive device includes a clip inserting mechanism having a handle for inserting a resilient clip into clothing, a slot projected into the handle, and a blade secured within the slot within the handle for cutting the resilient clip preparing the secured clothing for utilization.

In these respects, the Sock Clip System according to the present invention substantially departs from the conventional concepts and designs of the prior art, and in so doing provides an apparatus primarily developed for the purpose of securing stocking, socks, and hose and the like, into their proper pairs for ease of sorting for laundry and storage.

SUMMARY OF THE INVENTION

In view of the foregoing disadvantages inherent in the known types of Clothing Securing Devices now present in the prior art, the present invention provides a new Sock Clip System construction wherein the same can be utilized for securing stocking, socks, and hose and the like, into their proper pairs for ease of sorting for laundry and storage.

The general purpose of the present invention, which will be described subsequently in greater detail, is to provide a new Sock Clip System apparatus and method which has many of the advantages of the Clothing Securing Devices mentioned heretofore and many novel features that result in a new Sock Clip System which is not anticipated, rendered obvious, suggested, or even implied by any of the prior art Clothing Securing Devices, either alone or in any combination thereof.

To attain this, the present invention generally comprises a clip inserting mechanism having a handle for inserting a resilient clip into clothing, a slot projected into the handle, and a blade secured within the slot within the handle for cutting the resilient clip preparing the secured clothing for utilization.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Sock Clip System apparatus and method which has many of the advantages of the Clothing Securing Devices mentioned heretofore and many novel features that result in a new Sock Clip System which is not anticipated, rendered obvious, suggested, or even implied by any of the prior art Clothing Securing Devices, either alone or in any combination thereof.

It is another object of the present invention to provide a new Sock Clip System which may be easily and efficiently manufactured and marketed.

It is a further object of the present invention to provide a new Sock Clip System which is of a durable and reliable construction.

An even further object of the present invention is to provide a new Sock Clip System which is susceptible of a low cost of manufacture with regard to both materials and labor, and which accordingly is then susceptible of low prices of sale to the consuming public, thereby making such Sock Clip System economically available to the buying public.

Still yet another object of the present invention is to provide a new Sock Clip System which provides in the apparatuses and methods of the prior art some of the advantages thereof, while simultaneously overcoming some of the disadvantages normally associated therewith.

Still another object of the present invention is to provide a new Sock Clip System for securing stocking, socks, and hose and the like, into their proper pairs for ease of sorting for laundry and storage.

Yet another object of the present invention is to provide a new Sock Clip System which includes a clip inserting mechanism having a handle for inserting a resilient clip into clothing, a slot projected into the handle, and a blade secured within the slot within the handle for cutting the resilient clip preparing the secured clothing for utilization.

Still yet another object of the present invention is to provide a new Sock Clip System that reduces the number of mismatched and misplaced pairs of clothing.

Even still another object of the present invention is to provide a new Sock Clip System that saves clothing bills by reducing the number of lost pairs of clothing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
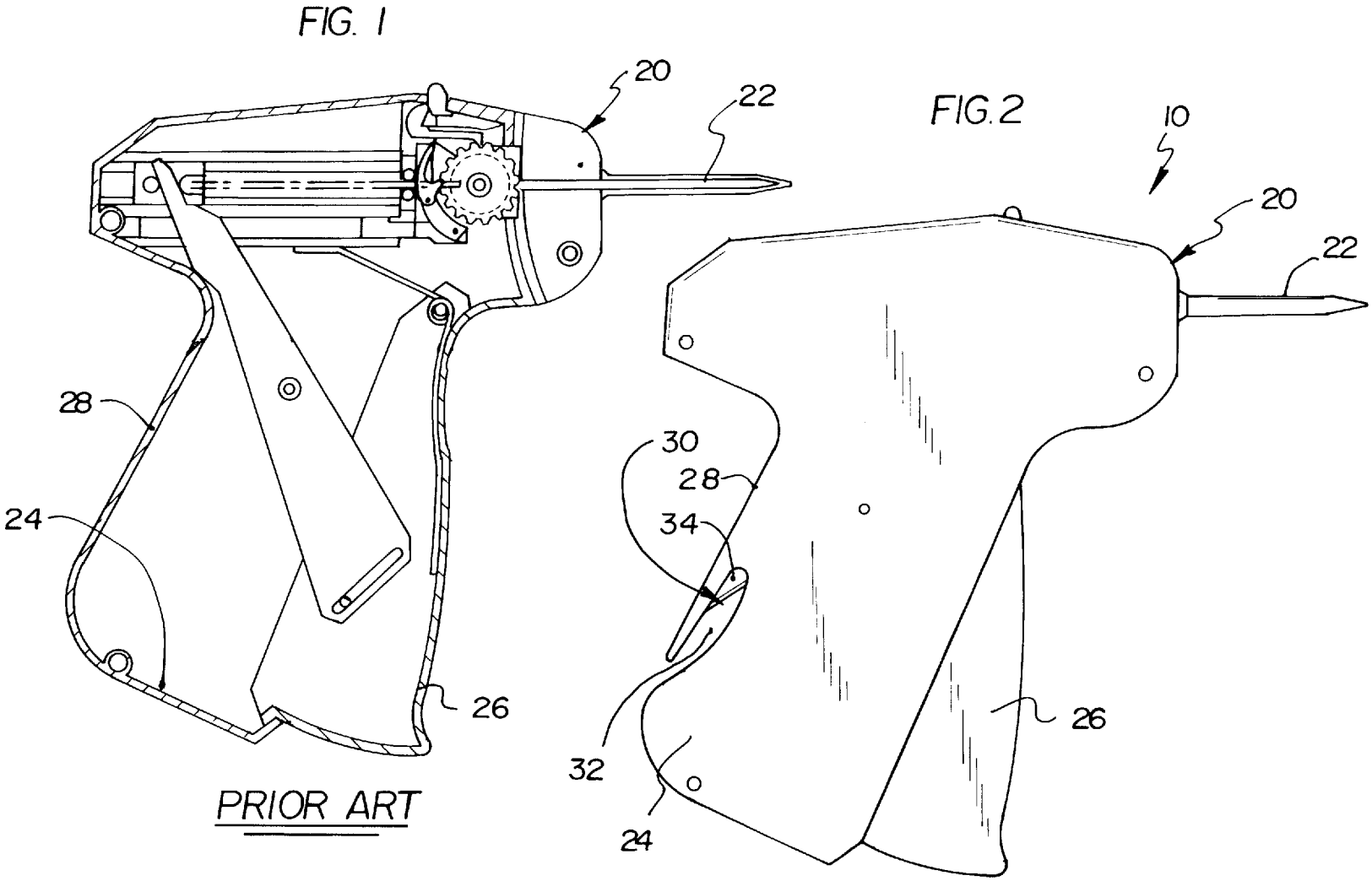
FIG. 1 PRIOR ART
FIG. 1 is a side cut away view of the prior art.
FIG. 2 is a side view of the present invention.

With reference now to the drawings, and in particular to FIGS. 1 through 7 thereof, a new Sock Clip System embodying the principles and concepts of the present invention and generally designated by the reference numeral 10 will be described.

As shown in FIG. 1 of the drawings, the prior art does not include a cutting means 30 for removal of a resilient clip 50 inserted by a clip inserting mechanism 20. A user therefor had to utilize a separate cutting means for cutting the resilient clip 50 from a pair of clothing. The present invention overcomes this limitation of the prior art by including the cutting means 30 in a safe and convenient position within a handle 24 of the clip inserting mechanism 20.

More specifically, it will be noted that the Sock Clip System 10 comprises a clip inserting mechanism 20 having a handle 24, a needle 22 and a lever 26 pivotally secured to the handle 24 for inserting a resilient clip 50 through the needle 22 into a pair of clothing for securing the pair of clothing, the handle 24 has a rear side 28 opposite of the lever 26, and a cutting means 30 attached to the rear side 28 of the handle 24 for cutting the resilient clip 50 for separating the pair of clothing for utilization by a user.

Figure 7:
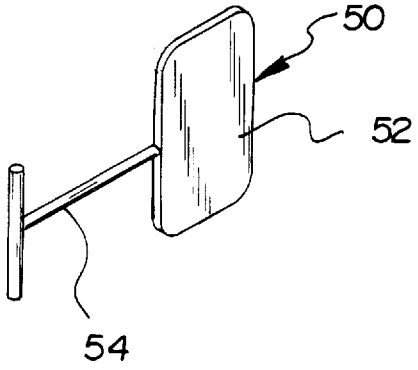
FIG. 7 is an upper perspective view of a resilient clip.

As best illustrated in FIG. 7 of the drawings, it can be shown that the resilient clip 50 comprises a head portion 52 and a T-shaped portion 54 for inserting into the clothing. The head portion 52 is substantially swaged. The T-shaped portion 54 has a longitudinal portion and a traverse portion, where the longitudinal portion is secured to the head portion 52 opposite of the traverse portion.

Figure 5:
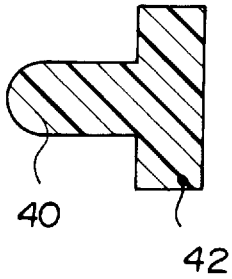
FIG. 5 is a cross sectional view taken along line 5—5 of FIG. 3.
Figure 6:
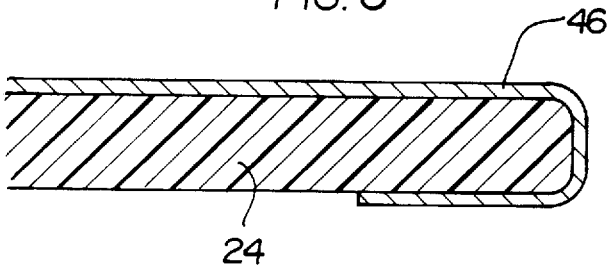
FIG. 6 is a cross sectional view taken along line 6—6 of FIG. 4.

As shown in FIGS. 2 and 5 of the drawings, the cutting means 30 comprises an arcuate slot 32 projecting into a lower portion of the handle 24 adjacent the rear side 28 for receiving the T-shaped portion 54 of the resilient clip 50. A blade 34 is secured within the arcuate slot 32 within the handle 24 for cutting the T-shaped portion 54 of the resilient clip 50 without injuring a hand of the user.

Figure 3:
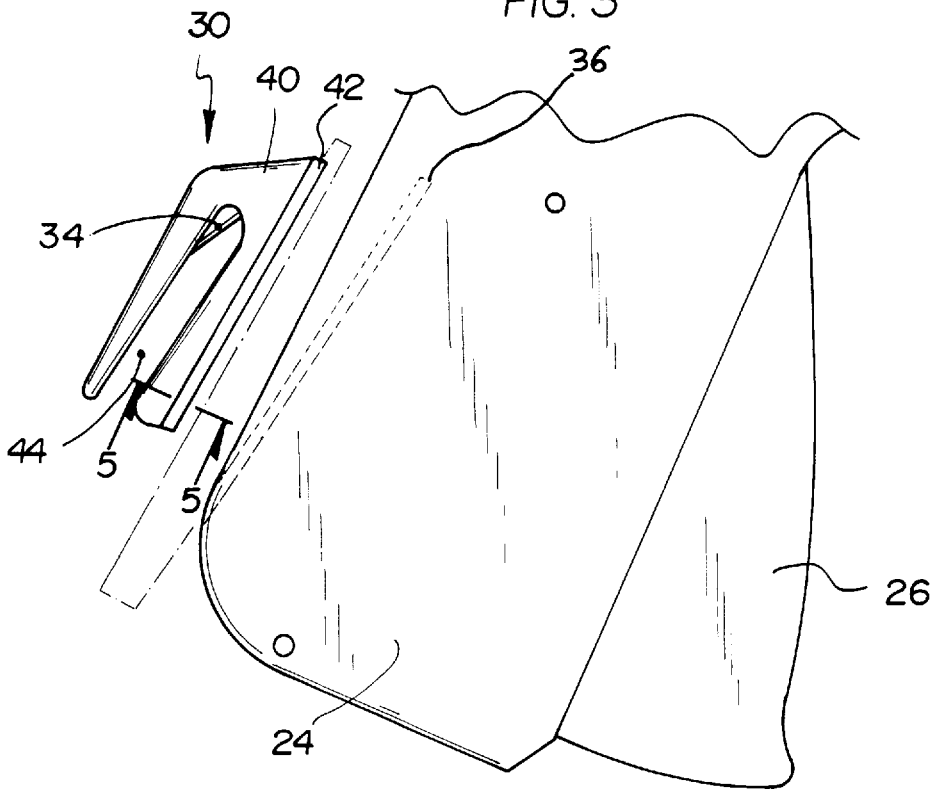
FIG. 3 is a magnified side view of an alternative embodiment of the present invention.

As shown in FIGS. 3 and 5 of the drawings, an alternative embodiment of the cutting means 30 comprises a T-slot 36 projecting at an angle into the rear side 28 within the handle 24 a finite distance. A U-shaped member 40 is substantially swaged forming a plane. The U-shaped member 40 has an elongated slot 44 defined by a pair of elongated sides. One elongated side secures a flange 42 traverse to the plane. The flange 42 is formed for snugly and slidably projecting into the T-slot 36 within the handle 24. The blade 34 is secured within the U-shaped member 40 projecting into the elongated slot 44 for cutting the T-shaped portion 54 of the resilient clip 50 without injuring a hand of the user.

Figure 4:
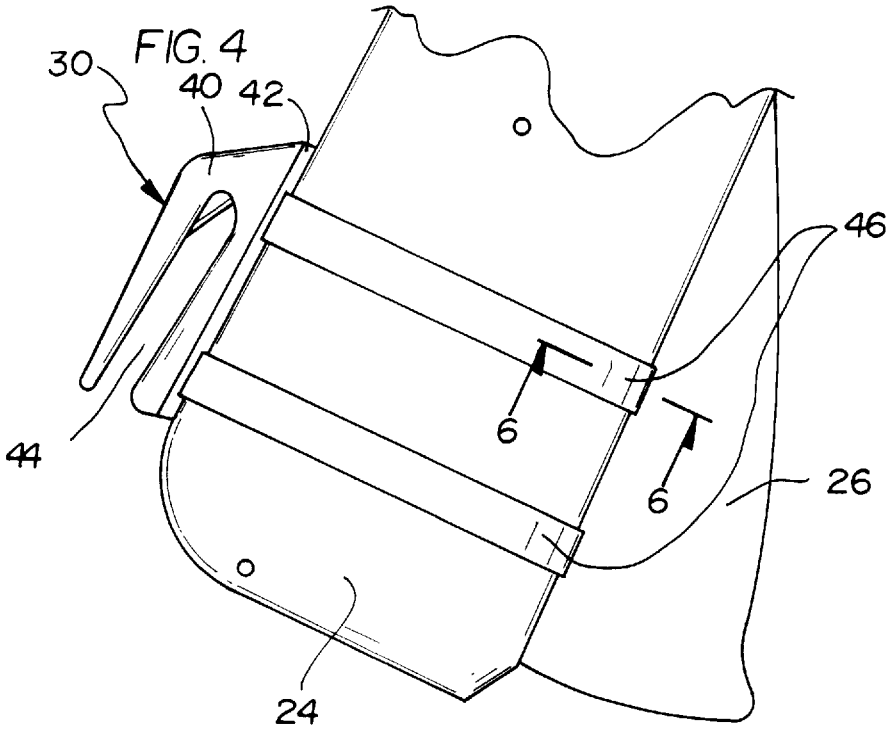
FIG. 4 is a magnified side view of another alternative embodiment of the present invention.

As shown in FIGS. 4 and 5 of the drawings, another alternative embodiment of the cutting means 30 comprises the U-shaped member 40 substantially swaged forming the plane having the elongated slot 44 defined by the pair of elongated sides. One elongated side secures the flange 42 traverse to the plane. The flange 42 is formed for being juxtaposed to the rear side 28. The blade 34 is secured within the U-shaped member 40 projecting into the elongated slot 44 for cutting the T-shaped portion 54 of the resilient clip 50 without injuring a hand of the user. At least one resilient strap 46 is secured to the flange 42 and removably surrounds the handle 24 for securing the flange 42 juxtaposed to the rear side 28.

In use, the user inserts the resilient clip 50 into the pair of clothing to be secured thereby securing the pair of clothing. The user thereafter may wash and dry the pair of clothing with other clothing without fear of losing a mate within the pair of clothing. After drying the pair of clothing, the user may retain the resilient clip 50 within thereby preventing separation of the pair of clothing during storage. When the user is ready to wear the pair of clothing, the user cuts the T-shaped portion 54 of the resilient clip 50 with the blade 34 secured to the handle 24 of the clip inserting mechanism 20 by one of the three embodiments. Thereafter, the user may remove and dispose of the resilient clip 50 within the pair of clothing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A Sock Clip System comprising:

a clip inserting mechanism having a handle, a needle and a lever pivotally secured to said handle for inserting a resilient clip through said needle into a pair of clothing for securing said pair of clothing;

said handle has a rear side opposite of said lever; and a cutting means attached to said rear side of said handle for cutting said resilient clip for separating said pair of clothing for utilization by a user.

2. The Sock Clip System of claim 1, wherein said resilient clip comprises:

a head portion substantially swaged; and a T-shaped portion having a longitudinal portion and a traverse portion, wherein said longitudinal portion is secured to said head portion opposite of said traverse portion.

3. The Sock Clip System of claim 2, wherein said cutting means comprises:

an arcuate slot projecting into a lower portion of said handle adjacent said rear side for receiving said T-shaped portion of said resilient clip; and a blade secured within said arcuate slot within said handle for cutting said T-shaped portion of said resilient clip without injuring a hand of said user.

4. The Sock Clip System of claim 2, wherein said cutting means comprises:

a T-slot projecting at an angle into said rear side within said handle a finite distance;

a U-shaped member substantially swaged forming a plane having an elongated slot defined by a pair of elongated sides;

one elongated side secures a flange traverse to said plane, wherein said flange is formed for snugly, slidably projecting into said T-slot; and a blade secured within said U-shaped member projecting into said elongated slot for cutting said T-shaped portion of said resilient clip without injuring a hand of said user.

5. The Sock Clip System of claim 2, wherein said cutting means comprises:

a U-shaped member substantially swaged forming a plane having an elongated slot defined by a pair of elongated sides;

one elongated side secures a flange traverse to said plane, wherein said flange is formed for being juxtaposed to said rear side;

a blade secured within said U-shaped member projecting into said elongated slot for cutting said T-shaped portion of said resilient clip without injuring a hand of said user; and at least one resilient strap secured to said flange and removably surrounding said handle for securing said flange juxtaposed to said rear side.

6. A method of attaching and removing a resilient clip to an article of clothing, said method comprising the steps of:

(a) providing a clip inserting mechanism and a pair of clothing;

(b) inserting said resilient clip with said clip inserting mechanism into said pair of clothing thereby securing said pair of clothing;

(c) cutting said resilient clip with a blade removably secured to a handle of said clip inserting mechanism; and (d) wearing said pair of clothing with said resilient clip removed.

* * * * *